US010526717B2

(12) United States Patent
Williams et al.

(10) Patent No.: US 10,526,717 B2
(45) Date of Patent: Jan. 7, 2020

(54) APPARATUS AND METHOD FOR SELECTIVELY TREATING A SURFACE OF A COMPONENT

(71) Applicant: Biomet UK Healthcare Limited, Bridgend (GB)

(72) Inventors: Andrew Williams, Cardiff (GB); Gethin Holloway, Cardiff (GB); Lyndon Stephens, Bridgend (GB); David Lloyd, Mid Glamorgan (GB); Richard Bye, Caerphilly (GB)

(73) Assignee: Biomet UK Healthcare Limited, Bridgend, South Wales (GB)

( * ) Notice: Subject to any disclaimer, the term of this patent is extended or adjusted under 35 U.S.C. 154(b) by 0 days.

(21) Appl. No.: 16/188,569

(22) Filed: Nov. 13, 2018

(65) Prior Publication Data

US 2019/0078228 A1 Mar. 14, 2019

Related U.S. Application Data

(63) Continuation of application No. 15/053,655, filed on Feb. 25, 2016, now abandoned.

(30) Foreign Application Priority Data

Feb. 27, 2015 (GB) ..... 1503437.4

(51) Int. Cl.
*C25D 11/02* (2006.01)
*C25D 11/00* (2006.01)
*C25D 17/14* (2006.01)

(52) U.S. Cl.
CPC ..... *C25D 11/005* (2013.01); *C25D 11/022* (2013.01); *C25D 17/14* (2013.01)

(58) Field of Classification Search
None
See application file for complete search history.

(56) References Cited

U.S. PATENT DOCUMENTS 2,540,602 A 2/1951 Thomas
3,361,662 A 1/1968 Sutch
(Continued)

FOREIGN PATENT DOCUMENTS

CN 203520115 U 4/2014

OTHER PUBLICATIONS

"U.S. Appl. No. 15/053,655 Non Final Office Action dated Apr. 20, 2018", 17 pgs.

(Continued)

*Primary Examiner* — Stefanie S Wittenberg
(74) *Attorney, Agent, or Firm* — Schwegman Lundberg & Woessner, P.A.

(57) ABSTRACT

An anodising apparatus for selectively anodizing at least a portion of a surface of a component can include a conformable wicking element configured to absorb a fluid, the conformable wicking element being conformable to at least the portion of the surface of the component, wherein, upon bringing the component into contact with the conformable wicking element, the fluid completes an electric circuit between the component and a conductive element, the anodising apparatus being configured to grow an anodised layer on the portion of the surface of the component that is in contact with the conformable wicking element when an electric current is supplied to the electric circuit between the conductive element and the component.

19 Claims, 3 Drawing Sheets

(56) References Cited

U.S. PATENT DOCUMENTS

| | | | | |
|---|---|---|---|---|
| 3,554,881 | A | 1/1971 | Piontelli et al. | |
| 3,637,468 | A | 1/1972 | Icxi et al. | |
| 4,159,934 | A | 7/1979 | Kadija | |
| 4,377,447 | A | 3/1983 | Bednarz | |
| 4,436,592 | A | 3/1984 | Norris et al. | |
| 4,661,213 | A | 4/1987 | Dorsett et al. | |
| 5,571,389 | A * | 11/1996 | Kerampran ..... | C25D 5/06 204/224 R |
| 5,833,820 | A | 11/1998 | Dubin | |
| 6,235,178 | B1 | 5/2001 | Tautz | |
| 6,261,433 | B1 | 7/2001 | Landau | |
| 6,375,823 | B1 | 4/2002 | Matsuda et al. | |
| 2002/0130034 | A1 | 9/2002 | Uzoh et al. | |
| 2004/0209092 | A1 | 10/2004 | Near | |
| 2014/0209471 | A1 | 7/2014 | Rubin et al. | |
| 2016/0251770 | A1 | 9/2016 | Williams et al. | |

OTHER PUBLICATIONS

"U.S. Appl. No. 15/053,655, Final Office Action dated Mar. 12, 2018", 15 pgs.
"U.S. Appl. No. 15/053,655, Final Office Action dated Mar. 28, 2017", 19 pgs.
"U.S. Appl. No. 15/053,655, Final Office Action dated Aug. 13, 2018", 25 pgs.
"U.S. Appl. No. 15/053,655, Non Final Office Action dated Aug. 8, 2016", 16 pgs.
"U.S. Appl. No. 15/053,655, Non Final Office Action dated Sep. 14, 2017", 17 pgs.
"U.S. Appl. No. 15/053,655, Response filed Dec. 15, 2017 to Non Final Office Action dated Sep. 14, 2017", 13 pgs.
"U.S. Appl. No. 15/053,655, Response filed May 7, 2018 to Non Final Office Action dated Apr. 20, 2018", 10 pgs.
"U.S. Appl. No. 15/053,655, Response filed Jun. 28, 2017 to Final Office Action dated Mar. 28, 2017", 14 pgs.
"U.S. Appl. No. 15/053,655, Response filed Nov. 8, 2016 to Non Final Office Action dated Aug. 8, 2016", 14 pgs.
"U.S. Appl. No. 15/053,655, Response filed Mar. 22, 2018 to Final Office Action dated Mar. 12, 2018", 9 pgs.
"European Application Serial No. 16157962.8, Communication Pursuant to Article 94(3) EPC dated Oct. 25, 2018", 7 pgs.
"European Application Serial No. 16157962.8, Extended European Search Report dated Jul. 7, 2016", 7 pgs.
"European Application Serial No. 16157962.8, Response filed Feb. 27, 2017 to Extended European Search Report dated Jul. 7, 2016", 11 pgs.
"United Kingdom Application Serial No. 1503437.4, Office Action dated Mar. 4, 2015", 2 pgs.
Wang, et al., Electronic translation of CN203520115.
"U.S. Appl. No. 15/053,655, Examiner Interview Summary dated Nov. 13, 2018", 3 pgs.
"European Application Serial No. 16157962.8, Response filed Mar. 12, 2019 to Communication Pursuant to Article 94(3) EPC dated Oct. 25, 2018", 15 pgs.

* cited by examiner

APPARATUS AND METHOD FOR SELECTIVELY TREATING A SURFACE OF A COMPONENT

The present disclosure relates to apparatus and a method for selectively, treating at least a portion of a surface of a component, and in particular, but not exclusively, relates to selectively anodising a surface of a component using surface treatment apparatus comprising a conformable wicking element.

PRIORITY APPLICATION

This application claims the benefit of priority under 35 U.S.C. 119 to United Kingdom Application No. 1503437.4 filed on Feb. 27, 2015 which application is incorporated herein by reference in its entirety.

BACKGROUND

During a surgical procedure, for example a hip arthroplasty, a surgeon may be provided with a set of differently sized prostheses from which the most suitable prosthesis may be chosen in accordance with the anatomy of the patient. A set of surgical instruments, for example trial implants, may be used whilst performing the surgical procedure to assess which size of prosthesis best matches the patient's anatomy. Each trial implant may have differently sized features that correspond to the differently sized prostheses. It is desirable, therefore, during surgery to be able to easily match the prosthesis and the corresponding trial implant.

It is known to colour-code components using anodisation techniques to help identify prostheses and tools. Such anodisation techniques typically involve immersing the component in acid to remove an oxide layer, and subsequently performing the anodisation by submerging the component an electrolyte fluid. However, it is very difficult to selectively anodise a specific surface of the component using such known techniques. Even if the component is partially immersed in the fluid to treat only a specific portion of the component, the surface tension of the fluid results in unwanted treatment of the component where the component breaks the surface of the fluid. It is desirable, therefore to selectively anodise only the specific surface of the component to avoid introducing any unwanted chemicals onto other surfaces of the component, for example surfaces of a prosthesis designed to engage a bone and/or another prosthetic component, and to avoid any unsightly anodisation gradients between treated surfaces and the surfaces adjoining the treated surfaces.

OVERVIEW

According to an aspect of the present disclosure there is provided anodising apparatus for selectively anodizing at least a portion of a surface of a component. The anodising apparatus comprises a conformable wicking element configured to absorb a fluid. The conformable wicking element is conformable to at least the said portion of the surface of the component. The fluid completes an electric circuit between the component and a conductive element upon bringing the component into contact with the conformable wicking element. The anodising apparatus is configured to grow an anodised layer on the said portion of the surface of the component that is in contact with the conformable wicking element when an electric current is supplied to the electric circuit between the conductive element and the component.

The fluid may be exposed to only the said portion of the surface of the component upon bringing the component into contact with the conformable wicking element. The conformable wicking element may be configured to absorb, for example draw, the fluid from a reservoir of fluid, for example by capillary action. The conformable wicking element may be at least partially submerged in the fluid. The conformable wicking element may be fabricated from a porous material. The conformable wicking element may a comprise a sheet of porous material. The conformable wicking element may be fabricated from a resilient material. The conformable wicking element may be in contact with the conductive element and the said portion of the surface of the component. The conformable wicking element may be configured to at least partially cover one or more surfaces of the conductive element. The conformable wicking element may be at least partially disposed in between the component and the conductive element. The conformable wicking element may be conformable to at least a portion of a surface of the conductive element.

The conductive element may comprise a planar surface at least partially in contact the conformable wicking element. The conductive element may comprise a surface having at least a portion that is of similar form to the said portion of the surface of the component. The conductive element may be configured to support the conformable wicking element. The conductive element may be at least partially submerged in the fluid. The conductive element may comprise a metallic plate. The conductive element may comprise one or more grooves running at least partially across a surface of the conductive element. The grooves may be configured to allow the fluid to flow at least partially across a surface of the conductive element. The grooves may extend at least partially across a surface of the conductive element from the periphery of the conductive element. The grooves may form a grid pattern on a surface of the conductive element. The grooves may be configured to drain fluid away from the conformable wicking element.

The conductive element may comprise a porous conductive material configured to absorb the fluid. The conductive element may comprise a first layer of a non-porous conductive material and a second layer of porous conductive material configured to absorb the fluid.

The anodising apparatus may comprise a second wicking element configured to absorb the fluid. The second wicking element may be in contact with the conformable wicking element. The conformable wicking element may be configured to draw the fluid from the second wicking element. The second wicking element may be at least partially disposed in between the conformable wicking element and the conductive element.

The fluid may comprise an electrolyte fluid. The fluid may comprise a cleaning fluid, for example a fluid configured to remove an oxide layer from the component.

The conformable wicking element may be remote from the conductive element. The fluid may connect electrically the conductive element to the conformable wicking element. The fluid may connect electrically the conductive element to the component.

The conformable wicking element may be supported by a non-conductive carrier member. The porosity of conformable wicking element may be selectable depending on a required flow rate of the fluid into, out of and/or through the conformable wicking element. The conformable wicking element may have a uniform thickness. The conformable wicking element may have a varying thickness. The conformable wicking element may comprise one or more raised surfaces configured to support the component.

The conductive element may form a cathode of the anodising apparatus. The component may form an anode of the anodising apparatus.

The anodising apparatus may comprise a pump configured to pump the fluid, for example towards and/or away from the conformable wicking element. The anodizing apparatus may comprise a rotational drive configured to rotate the component and/or one or more components of the anodising apparatus, for example the conductive element and/or the conformable wicking element. The anodising apparatus may comprise an actuator, for example a linear actuator, configured to move, for example translate, the component and/or one or more components of the anodising apparatus, for example the conductive element and/or the conformable wicking element. The anodising apparatus may comprise a vibrating device configured to vibrate the component and/or one or more components of the anodising apparatus, for example the conductive element and/or the conformable wicking element. The anodizing apparatus may comprise a loading device configured to adjust the contact pressure between the component and the conformable wicking element.

The anodising apparatus may comprise a controller configured to adjust the electric current applied between the component and the conductive element. The controller may be configured to modulate an alternating current supply applied between the component and the conductive element. The controller may be configured to control one or more of: the rotational drive; the linear actuator; the vibrating device; the loading device; and the pump.

The component may be a prosthesis, for example an acetabular cup. The component may be a tool, for example a reaming tool, for use during a surgical procedure.

The conformable wicking element may be remote from the conductive element. The fluid may connect electrically the conductive element to the conformable wicking element. The fluid may connect electrically the conductive element to the component.

According to another aspect of the present invention there is provided a method of selectively anodizing at least a portion of a surface of a component using anodizing apparatus. The anodising apparatus comprises a conformable wicking element conformable to at least the portion of the surface of the component. The conformable wicking element is configured to absorb an fluid. The fluid completes an electric circuit between the component and a conductive element. The method comprises priming the conformable wicking element with the fluid. The method comprises bringing the component into contact with the conformable wicking element to complete the electric circuit between the component and the conductive element. The method comprises applying an electric current between the conductive element and the component to grow an anodised layer on the portion of the surface of the component that is in contact with the conformable wicking element.

The method may comprise rotating the component and/or one or more components of the anodising apparatus using a rotational drive. The method may comprise rotating the component relative to one or more components of the anodising apparatus, for example the conformable wicking element, using a rotational drive. The method may comprise moving the component and/or one or more components of the anodising apparatus using an actuator, for example a linear actuator. The method may comprise moving the component relative to one or more components of the anodising apparatus, for example the conformable wicking element, using an actuator.

The method may comprise vibrating the component and/or one or more components of the anodising apparatus using a vibrating device.

The method may comprise adjusting the contact pressure between the component and the conformable wicking element using a loading device. The loading device may be configured to increase and/or decrease the contact pressure depending on the requirements of the anodising process. For example, if the surface portion to be anodised is small and/or if the component is heavy, the contact pressure between the component and the conformable wicking element will be high, and the loading device may be configured to reduce the contact pressure. Conversely, if the surface portion to be anodised is large and/or if the component is light, the contact pressure between the component and the conformable wicking element will be low, and the loading device may be configured to increase the contact pressure.

The method may comprise controlling, for example adjusting, the electric current supplied to the electric circuit using a controller. For example, the controller may be configured to modulate an alternating current (AC) supply. The controller may be configured to control at least one of the rotational movement and/or linear movement of the component and/or one or more components of the anodising apparatus, for example the conductive element and/or the conformable wicking element.

According to another aspect of the present invention there is provided a surface treatment apparatus for selectively treating at least a portion of a surface of a component. The surface treatment apparatus comprises a conformable wicking element configured to absorb a fluid. The conformable wicking element is conformable to at least the said portion of the surface of the component. The surface treatment apparatus is configured to expose only the said portion of the surface of the component to the fluid.

The surface treatment apparatus may further comprise a second wicking element configured to absorb the fluid. The second wicking element may be in contact with the conformable wicking element. The conformable wicking element may be configured to draw the fluid from the second wicking element.

The fluid may be exposed to the said portion of the surface of the component upon bringing the component into contact with the conformable wicking element.

The conformable wicking element and/or the second wicking element may be configured to absorb, for example draw, the fluid from a reservoir of fluid. The conformable wicking element and/or the second wicking element may be at least partially submerged in the fluid. The conformable wicking element and/or the second wicking element may comprise one or more sheets of porous material.

The surface treatment apparatus may be configured to clean the said portion of the surface of the component that is in contact with the conformable wicking element. The fluid may comprise a cleaning fluid, for example an acid configured to remove a layer of metal oxide from the surface of a metal component.

The fluid may complete an electric circuit between the component and a conductive element upon bringing the component into contact with the conformable wicking element.

The surface treatment apparatus may be configured to grow an anodised layer on the said portion of the surface of the component that is in contact with the conformable wicking element upon supplying an electric current to the electric circuit between the conductive element and the component.

The conformable wicking element may be in contact with the conductive element and the said portion of the surface of the component. The conformable wicking element may be at least partially disposed in between the component and the conductive element. The conformable wicking element may be configured to at least partially cover one or more surfaces of the conductive element. The conformable wicking element may be conformable to at least a portion of a surface of the conductive element.

The conductive element may comprise a planar surface at least partially in contact the conformable wicking element. The conductive element may comprise a surface having at least a portion that is of similar form to the said portion of the surface of the component. The conductive element may be configured to support the conformable wicking element. The conductive element may be at least partially submerged in the fluid. The conductive element may comprise a metallic plate. The conductive element may comprise one or more grooves running at least partially across a surface of the conductive element. The grooves may be configured to allow the fluid to flow at least partially across a surface of the conductive element. The grooves may extend at least partially across a surface of the conductive element from the periphery of the conductive element. The grooves may form a grid pattern on a surface of the conductive element. The grooves may be configured to drain fluid away from the conformable wicking element.

The conductive element may comprise a porous conductive material configured to absorb the fluid. The conductive element may comprise a first layer of a non-porous conductive material and a second layer of porous conductive material configured to absorb the fluid.

The conformable wicking element may be supported by a non-conductive carrier member. The porosity of conformable wicking element may be selectable depending on required flow rate of the fluid into, out of or through the conformable wicking element. The conformable wicking element may have a uniform thickness. The conformable wicking element may have a varying thickness. The conformable wicking element may comprise one or more raised surfaces configured to support the component.

The conductive element may form a cathode of the anodising apparatus. The component may form an anode of the anodising apparatus.

The surface treatment apparatus may comprise a pump configured to pump the fluid, for example towards and/or away from the conformable wicking element. The anodising apparatus may comprise a rotational drive configured to rotate the component and/or one or more components of the anodising apparatus, for example the conductive element and/or the conformable wicking element. The anodising apparatus may comprise an actuator, for example a linear actuator, configured to move, for example translate, the component and/or one or more components of the anodising apparatus, for example the conductive element and/or the conformable wicking element. The anodising apparatus may comprise a vibrating device configured to vibrate the component and/or one or more components of the anodising apparatus, for example the conductive element and/or the conformable wicking element. The anodising apparatus may comprise a loading device configured to adjust the contact pressure between the component and the conformable wicking element.

The surface treatment apparatus may comprise a controller configured to adjust the electric current applied between the component and the conductive element. The controller may be configured to modulate an alternating current supply applied between the component and the conductive element. The controller may be configured to control one or more of: the rotational drive; the linear actuator, the vibrating device; the loading device; and the pump.

The component may be a prosthesis, for example an acetabular cup. The component may be a tool, for example a reaming tool, for use during a surgical procedure.

The component may be a prosthesis, for example an acetabular cup. The component may be a tool, for example a tool, e.g. a reaming tool, for use during a surgical procedure.

The conformable wicking element may be remote from the conductive element. The fluid may electrically connect the conductive element to the conformable wicking element. The fluid may electrically connect the conductive element to the component.

According to another aspect of the present invention there is provided a method of selectively treating at least a portion of a surface of a component using surface treatment apparatus. The surface treatment apparatus comprises a conformable wicking element configured to absorb a fluid. The conformable wicking element is conformable to at least the said portion of the surface of the component. The surface treatment apparatus is configured to expose only the said portion of the surface of the component to the fluid. The method comprises priming the conformable wicking element with the fluid. The method comprises bringing the component into contact with the conformable wicking element to expose only the said portion of the surface of the component to the fluid. The method comprises treating the said portion of the surface of the component that is in contact with the conformable wicking element.

According to another aspect of the present invention there is provided a surface cleaning apparatus for selectively cleaning at least a portion of a surface of a component. The surface cleaning apparatus comprises a first wicking element configured to absorb a cleaning fluid. The surface cleaning apparatus comprises a conformable second wicking element in contact with the first wicking element. The conformable wicking element is conformable to at least the said portion of the surface of the component. The conformable wicking element is configured to draw the cleaning fluid from the first wicking element. The cleaning fluid is exposed to the said portion of the surface of the component upon bringing the component into contact with the conformable wicking element. The surface cleaning apparatus is configured to clean the said portion of the surface of the component that is in contact with the conformable wicking element. The surface cleaning apparatus may be used to clean the said portion of the surface of the component prior to using the above-mentioned anodising apparatus to anodise the said surface of the component. The surface cleaning apparatus may be used to clean an anodised portion of the surface of the component.

According to another aspect of the present invention there is provided a method of selectively cleaning at least a portion of a surface of a component using a surface cleaning apparatus. The surface cleaning apparatus comprises a first wicking element configured to absorb a cleaning fluid. The surface cleaning apparatus comprises a conformable second wicking element in contact with the first wicking element. The conformable wicking element is conformable to at least the said portion of the surface of the component. The conformable wicking element is configured to draw the cleaning fluid from the first wicking element. The method comprises priming the first wicking element with the cleaning fluid. The method comprises bringing the component into contact with the conformable wicking element to expose the said portion of the surface of the component to the cleaning fluid. The method comprises cleaning the said portion of the surface of the component that is in contact with the conformable wicking element.

According to another aspect of the present invention there is provided surface treatment apparatus for selectively cleaning and selectively anodizing at least a portion of a surface of a component. The surface treatment apparatus comprises a first surface treatment apparatus, for example a surface cleaning apparatus, and a second surface treatment apparatus, for example an anodising apparatus.

The first surface treatment apparatus comprises a first wicking element configured to absorb a cleaning fluid. The first surface treatment apparatus comprises a conformable second wicking element in contact with the first wicking element. The conformable second wicking element is conformable to at least the said portion of the surface of the component. The conformable second wicking element is configured to draw the cleaning fluid from the first wicking element. The cleaning fluid is exposed to the said portion of the surface of the component upon bringing the component into contact with the conformable second wicking element. The first surface treatment apparatus is configured to clean the said portion of the surface of the component that is in contact with the conformable second wicking element.

The second surface treatment apparatus comprises a conformable third wicking element conformable to at least the said portion of the surface of the component. The conformable wicking element is configured to absorb an electrolyte fluid. The electrolyte fluid completing an electric circuit between the component and a conductive element upon bringing the component into contact with the conformable third wicking element. The second surface treatment apparatus is configured to grow an anodised layer on the portion of the surface of the component that is in contact with the conformable third wicking element upon applying an electric current between the conductive element and the component.

According to another aspect of the present invention there is provided a method of selectively cleaning and selectively anodizing at least a portion of a surface of a component. The method comprises cleaning at least the said portion of the surface of the component using a first surface treatment apparatus, for example a surface cleaning apparatus, and subsequently anodising at least the said portion of the surface of the component using a second surface treatment apparatus, for example an anodising apparatus.

The surface treatment apparatus and methods disclosed herein are not specific to the treatment, for example the cleaning and/or anodisation, a prosthesis. It is appreciated that the surface treatment apparatus and methods disclosed herein may be used in any other sector, for example the automotive industry.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1A:
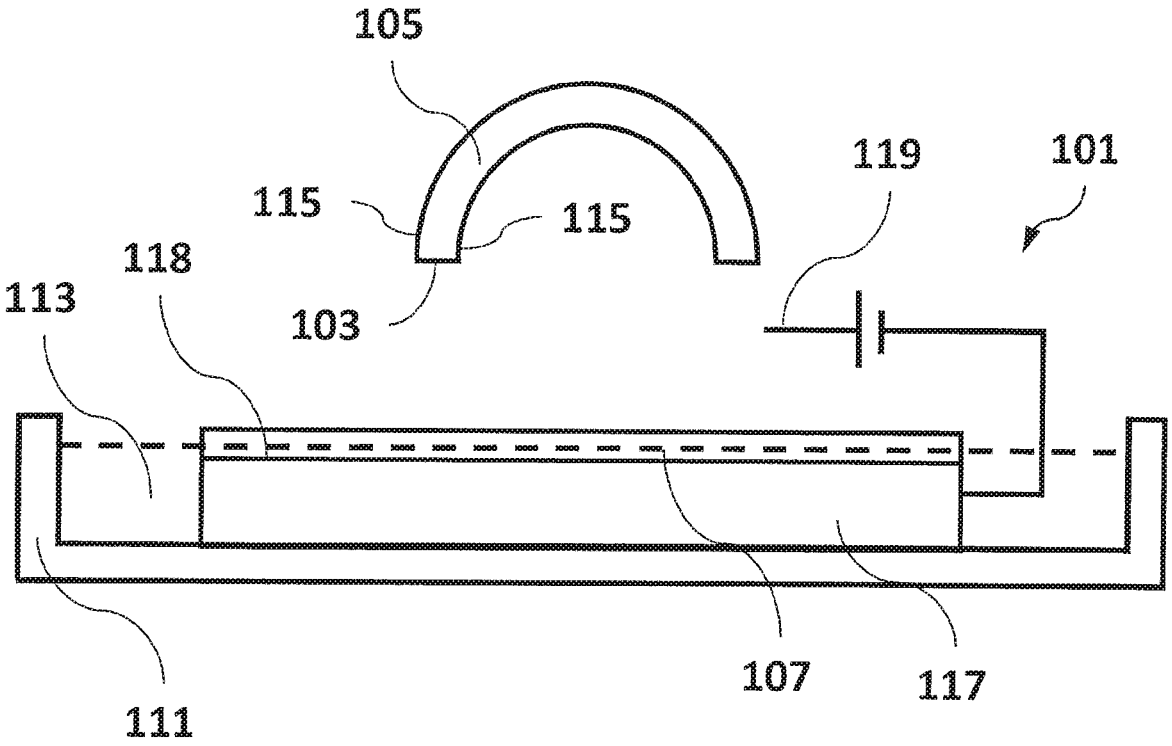
FIG. 1*a* shows surface treatment apparatus configured to grow an anodised layer on at least a portion of a component.
Figure 1B:
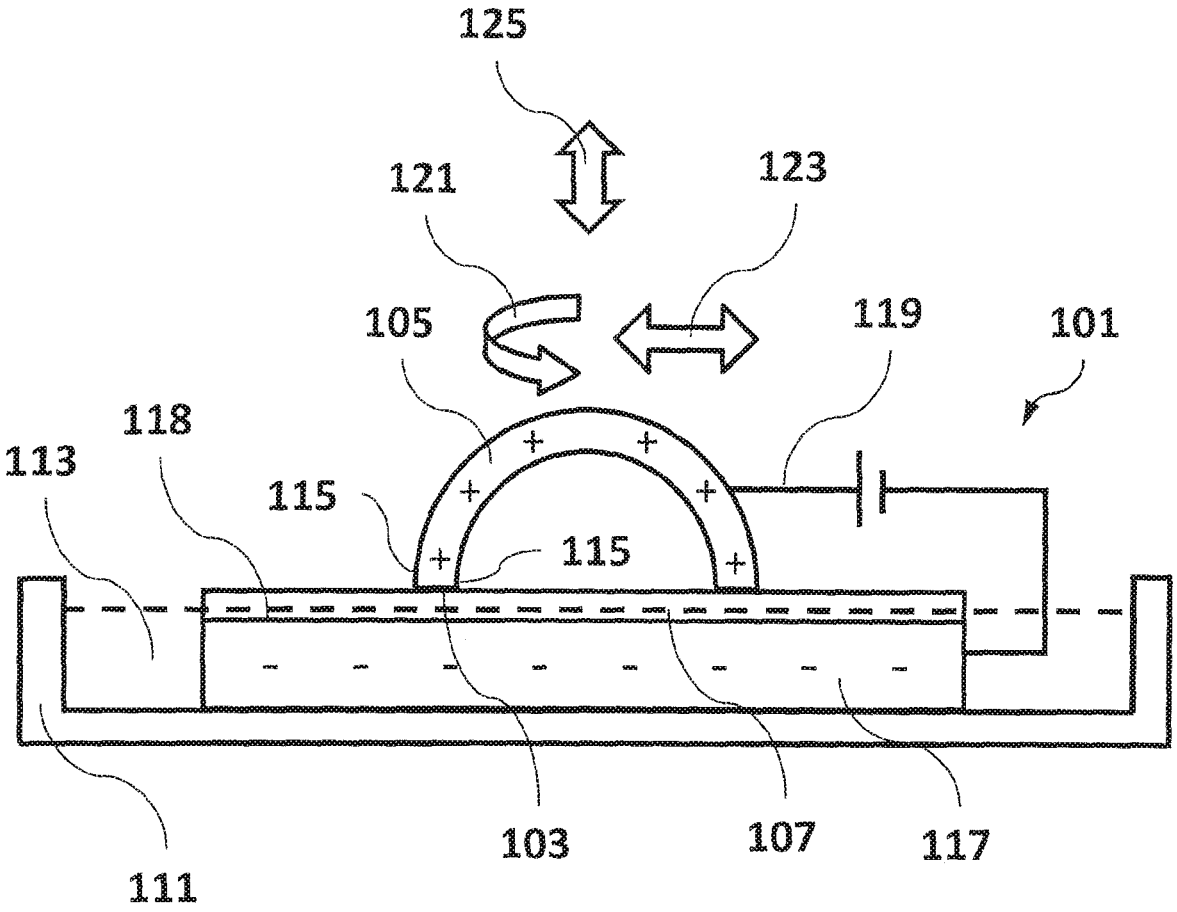
FIG. 1*b* shows surface treatment apparatus configured to grow an anodised layer on at least the said portion of the component.

FIGS. 1*a* and 1*b* show surface treatment apparatus 101 for selectively treating, e.g. anodising apparatus for selectively anodising, at least a portion 103 of a surface of a component 105. In the example of FIGS. 1*a* and 1*b*, the component 105 comprises a prosthesis, for example an acetabular cup. It is appreciated, however, that the surface treatment apparatus 101 may be used to treat any appropriate component and/or tool, for example a component and/or tool used in the automotive industry.

In the example of FIGS. 1*a* and 1*b*, the surface treatment apparatus 101 comprises a conformable wicking element 107 and a conductive element 117 disposed in a fluid reservoir 111 containing a fluid 113. The fluid 113 may comprise an electrolyte fluid, for example sodium carbonate solution, sulphuric acid, phosphoric acid, or any other fluid suitable for use in an anodisation process. The conductive element 117 is submerged in the fluid 113 and is configured to support the conformable wicking element 107 such that the conformable wicking element 107 is partially submerged in the fluid 113. The conformable wicking element 107 is configured to absorb the fluid 113, for example by virtue of capillary action, directly from the fluid reservoir 111. In this manner, the conformable wicking element 107 is primed with the fluid 113.

The conformable wicking element 107 may be fabricated from a porous wicking material configured to absorb the fluid 113 by capillary action. The pore size of the porous wicking material may be selected according to the desired rate of absorption of the fluid 113. The selection of the characteristics of the porous wicking material is key to enabling an anodisation process, in particular, the pore size must be selected to allow the conformable wicking element 107 to hold an appropriate amount of electrolyte fluid. If the pore size is too large, too much fluid is wicked and the conformable wicking element 107 may become saturated. If the pore size is too small blockage of the pores may occur as a result of deposition of a salt of the electrolyte fluid, for example a sodium carbonate salt. In one example, the porous material may have a pore size between approximately 5 μm (micrometres) and 100 μm, for example the pore size may be approximately 35 μm. In the example of FIGS. 1*a* and 1*b* the conformable wicking element 107 comprises a fibrous paper, although various other wicking materials may be used, for example a resilient open-cell foam. In another example, the conductive element 117 may comprise a porous conductive material configured to absorb the fluid 113, for example a carbon doped porous polyethylene, a conductive neoprene and/or an open-cell conductive rubber, that allows both electrical conduction and wicking of the fluid. In a further example, the conductive element 117 may comprise a sandwich construction having a plurality of layers, for example a first layer of a non-porous conductive material and a second layer of porous material configured to absorb the fluid 113.

The conformable wicking element 107 is conformable to at least the said portion 103 of the surface of the component 105 such that, upon bringing the component 105 into contact with the conformable wicking element 107, only the said portion 103 of the surface of the component 105 is exposed to the fluid 113 held by the conformable wicking element 107. FIG. 1*b* shows the component 105, for example an acetabular cup, in contact with the conformable wicking element 107. In the example of FIG. 1*b* only the rim of the acetabular cup is in contact with the conformable wicking element 107. In this manner, the surface treatment apparatus 101 is configured to treat only a selected surface of component 105.

The material from which the conformable wicking element 107 is fabricated is selected to ensure congruent contact between the said portion 103 of the surface of the component 105 and the conformable wicking element 107. The conformable wicking element 107 may be configured to deform upon bringing the component 105 into contact with the conformable wicking element 107. In this manner, the surface treatment apparatus 101 is configured to ensure that the fluid 113 is evenly exposed to only the said portion 103 of the surface to be treated. The surface treatment apparatus 101 is configured to ensure that the fluid 113 is not exposed to any other surface of the component, for example one or more portions 115 of a surface that adjoins and/or is 30 proximate to the said portion 103 of the surface to be treated.

The surface treatment apparatus 101 comprises an electric circuit 119 connected between the component 105 and the conductive element 119. When the component 105 is in contact with conformable wicking element 107, the fluid 113 absorbed into the conformable wicking element 107 completes the electric circuit 119.

The surface treatment apparatus 101 is configured to grow an anodised layer on the said surface portion 103 that is in contact with the conformable wicking element 107 when an electric current is applied to the electric circuit 119. Since the fluid 113 is exposed only to the said portion 103 of the surface of the component 105, the surface treatment apparatus 101 according to the present disclosure mitigates growing an anodised layer on any surface, or portions 115 of any surface, other than the said surface portion 103. The present disclosure therefore ensures the controlled treatment of one or more selected portions 103 of the surface of the component 105. In certain examples, the surface portions 115 that adjoin and/or are proximate to the said surface portion 103 may comprise other surface coatings, for example a porous hydroxyapatite coating. The surface treatment apparatus 101 according to the present disclosure is beneficial as it is possible to avoid the chemical entrapment of any unwanted metal oxides into those surface portions 115. In other examples, the surface portions 115 that adjoin and/or are proximate to the said surface portion 103 may have been precision manufactured within exact tolerances. As such, it is undesirable to introduce any unwanted surface treatments that may alter the dimension and/or form of the surface portions 115. This in particularly important where the surface portion 115 is a bearing surface that engages a corresponding bearing surface on another component in use. The present disclosure therefore allows for the selective anodisation of one or more surfaces without the risk of changing the surface characteristics of any other surface of the component.

The anodized layer is grown on the surface portion 103 by passing a current through the electrolyte fluid 113. When the component 105 is brought into contact with the surface treatment apparatus 101, the component 105 serves as an anode and the conductive element 117 serves as a cathode.

When the current is supplied to the electric circuit 119, hydrogen is released at the cathode, i.e. the conductive element 117, and oxygen is released at the surface of the anode, i.e. the component 105, which creates a build-up of metal oxide on the surface portion 103.

For the example of the acetabular cup, it is possible to utilise an existing feature of the component, e.g. a threaded impaction hole, to connect the component into the electric circuit 119. The component 105 need not be specially modified for incorporation into the surface treatment apparatus 101. The surface treatment apparatus 101 may comprise a number of different anode connectors, each specifically designed to connect to different components 105. In a similar manner, the surface treatment apparatus 101 may comprise a number of cathode connectors each configured to connect to differently shaped conductive elements 117.

The voltage required may range from approximately 1 to 300 V, although typically may be in the range of approximately 50 to 70 V. A higher voltage may be required in order to grow a thicker anodised layer on the surface portion 103. The resultant coloured appearance of the surface portion 103 is dependent on the thickness of the metal oxide, and hence the applied voltage. The coloured appearance results from the interference of light reflecting off the metal oxide surface and the underlying metal surface.

The applied current may be a direct current (DC) or an alternating current (AC). The magnitude of the applied current may be selected depending on the surface area of the surface portion 103. The applied current density may typically range from approximately 30 to 300 amperes/meter$^2$ (A/m$^2$). As the surface portion 103 becomes anodised and the metal oxide layer increases in thickness, the resistance of the electric circuit 119 increases, thus reducing the current drawn from the power supply. At the point that the electric current reaches approximately zero amperes, the component 105 may be removed from the surface treatment apparatus 101.

In the example of FIGS. 1*a* and 1*b*, the surface treatment apparatus 101 is configured to treat the rim of the acetabular cup. As such, the conductive element 117 comprises a metallic plate comprising a planar surface 118 of similar form to the surface portion 103 of the rim of the acetabular cup. The conformable wicking element 107 is conformable to and covers the planar upper surface of the conductive element 117 such that it is not possible to expose the rim of the acetabular cup to the conductive element 117.

In an alternative example, the surface treatment apparatus 101 may be configured to treat one or more at least partially curved surfaces of a component 105. The conductive element 117 may comprise correspondingly shaped surfaces that match the form of the one or more curved surfaces of a component 105. For example, the component 105 may comprise one or more convex surfaces and the conductive element 117 may comprise corresponding concave surfaces configured to receive the one or more curved convex surfaces of the component 105. The conformable wicking element 107 may be configured to conform to the convex surfaces and/or the concave surfaces such that the conformable wicking element 107 is at least partially disposed in between and in contact with the component 105 and the conductive element 117. In another alternative example, the conformable wicking element 107 may be configured to extend across an opening in the conductive element 117 such that the conformable wicking element 107 at least partially supports the component 105 over the opening in the conductive element 117.

In the example of FIGS. 1*a* and 1*b* the conductive element 117 is submerged in the fluid 113 and is configured to support the conformable wicking element 107 such that the component 105 is supported above the surface of the fluid 113. In another example, the conformable wicking element 107 may comprise one or more raised surface features configured to support the component 105 above the surface of the fluid 113. In this manner, the conformable wicking element 107 may be configured to draw the fluid 113 directly from the fluid reservoir 111 and support and/or separate the component from the fluid 113. In another example, the conformable wicking element 107 may support the component 105 above the surface of the fluid 113 and may be remote from the conductive element 117.

In one example of the present disclosure, the conductive element 117 may, comprise one or more grooves and/or recesses running at least partially across a surface of the conductive element 117. In the example of FIGS. 1*a* and 1*b*, the grooves may be disposed in the upper surface 118 of the conductive element 117 that supports the conformable wicking element 107. The grooves may be configured to allow the fluid 113 to flow across the upper surface 118 of the conductive element 117. The grooves of the conductive plate 117 may act to drain excess fluid 113 away from the interface between the conductive element 117 and the conformable wicking element 107. The grooves may be configured to supply the conformable wicking element 107 with the minimum required amount of fluid 113 to avoid the conformable wicking element 107 becoming saturated. In one example, the grooves may form a grid pattern across the upper surface 118 of the conductive element 117. The conformable wicking element 107 may comprise one or more projections that extend into the grooves and beneath the surface of the fluid 113. In this manner, the upper surface 118 of the conductive element 117 may be disposed above the surface of the fluid 113 with the base of the grooves being disposed below the surface of the fluid 113.

In a further example of the present disclosure, the surface treatment apparatus 101 may comprise a rotational drive and/or an actuator, for example a linear actuator, configured to rotate and/or move the component 105 relative to the conformable wicking element 107. Rotation and translation movements of the component 105 are represented by arrow 121 and arrow 123 respectively in FIG. 1*b*. In some examples, movement of the component 105 relative to the conformable wicking element 107 may result in a more uniform anodised layer by preventing the contact region between the conformable wicking element 107 and the surface portion 103 from drying out. If the conformable wicking element 107 were to become too dry, the component 105 may become damaged as a result of sparking between the component 105 and the conductive element 117.

In another example of the present disclosure, the surface treatment apparatus 101 may comprise a vibrating device configured to vibrate the surface treatment apparatus 101 and/or the component 105. In one example, the vibrating device may be configured to vibrate the conductive element 117. It may be advantageous to vibrate the surface treatment apparatus 101 and/or the component 105 during the anodisation process as vibrations may aid the conformable wicking element 107 absorb the fluid 113 and may mitigate the conformable wicking element 107 drying out during the anodisation process.

In another example of the present disclosure, the surface treatment apparatus 101 may comprise a loading device configured to adjust the contact pressure between the component 105 and the conformable wicking element 107, as indicated by arrow 125 in FIG. 1*b*. The loading device may be used to increase the contact pressure to ensure that the conformable wicking element 107 conforms to the shape of the surface portion 103 such that the surface portion 103 is sufficiently exposed to the fluid 113.

In another example of the present disclosure, the surface treatment apparatus 101 may comprise a sprayer configured to spray the fluid 113 directly on to the conformable wicking element 107. In this manner, the conformable wicking element 107 need not be partially submerged within the fluid 113 in the fluid reservoir 111, and the conductive element 117 may be configured to support the conformable wicking element 107 above the level of the fluid 113 in the fluid reservoir 111. The conformable wicking element 107 may be primed with the fluid 113 from the sprayer instead of from the reservoir 111.

In another example of the present disclosure, the surface treatment apparatus 101 may comprise a pump configured to pump the fluid 113. In one example, the conductive element 117 may comprise one or more channels extending through the conductive element 117. The channels may be configured to connect the pump fluidically to the interface between a surface, e.g. the upper surface 118, of the conductive element 117 and the conformable wicking element 107. The pump may be used to pump the fluid 113 through channels in order to supply the fluid 113 to and/or drain the fluid 113 from the interface between the upper surface 118 of the conductive element 117 and the conformable wicking element 107. The pump may be used to pump the fluid 113 from the fluid reservoir 111 to the sprayer for the purpose of priming the conformable wicking element 107.

In another example of the present disclosure, the surface treatment apparatus 101 may comprise a controller. The controller may be configured to control the electric current supply. The controller may be used to modulate an AC supply applied between the component 105 and the conductive element 117. The controller may be used to monitor the electrical resistance of the electric circuit 119 to determine the thickness of the anodised layer. The controller may be configured to automatically adjust the current depending on the electrical resistance of the electric circuit 119. The controller may be configured to control one or more of: the rotational drive; the actuator; the vibrating device; the loading device; and the pump.

The present disclosure provides a method of selectively anodizing at least the portion 103 of a surface of a component 105 using the anodising apparatus 101. The method comprises priming the conformable wicking element 107 with the fluid 113. The fluid may be drawn directly from the fluid reservoir 111 or applied by any other appropriate method, for example spraying the fluid 113 on to the conformable wicking element 107 and/or dipping the conformable wicking element 107 in the fluid 113 prior to assembly onto the conductive element 117. The method further comprises bringing the component 105, for example the surface portion 103, into contact with the conformable wicking element 107 in order to complete the electric circuit 119 between the conductive element 117 and the component 105. The electric current is then applied between the conductive element 117 and the component 105 to grow the anodised layer on the portion 103 of the surface of the component that is in contact with the conformable wicking element 107.

Figure 2:
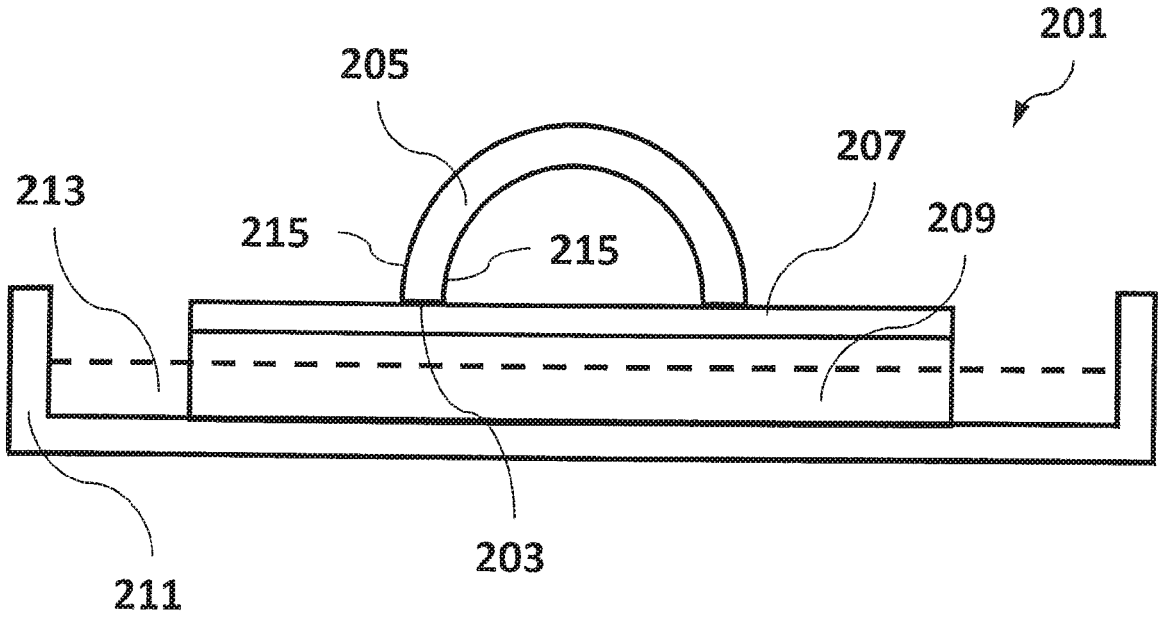
FIG. 2 shows surface treatment apparatus configured to clean at least a portion of a component.

FIG. 2 shows another embodiment of the surface treatment apparatus 201 for selectively treating, e.g. cleaning apparatus for selectively cleaning, at least a portion 203 of a surface of a component 205 according to the present disclosure.

In the embodiment of FIG. 2, the surface treatment apparatus 201 comprises the conformable wicking element 207 and a second wicking element 209 disposed in the fluid reservoir 211 containing the fluid 213. The conformable wicking element 207 and the second wicking element 211 are configured to absorb the fluid 213, for example by virtue of capillary action. The wicking element 207 and/or the second wicking element 211 may be fabricated from a porous material. The pore size of the porous material from which the conformable wicking element 207 and/or the second wicking element 209 is fabricated from may be selected depending on the desired rate of absorption of the fluid 213. The conformable wicking element 207 and/or the second wicking element 211 may be fabricated from different porous materials.

In the illustrated embodiment, the second wicking element 209 is partially submerged in the fluid 213 such that the second wicking element 209 is able to draw the fluid 213 through the thickness of the second wicking element 209. The conformable wicking element 207 is in contact with the second wicking element 211 such that the conformable wicking element 207 is able to draw the fluid 213 from the second wicking element 209. In this manner, the conformable wicking element 207 is primed with the fluid 213.

The conformable wicking element 207 is conformable to at least the said portion 203 of the surface of the component 205 such that, upon bringing the component 205 into contact with the conformable wicking element 207, only the said portion 203 of the surface of the component 205 is exposed to the fluid 213. FIG. 2 shows the component 205, for example an acetabular cup, in contact with the conformable wicking element 207. In the embodiment of FIG. 2 only the rim of the acetabular cup is in contact with the conformable wicking element 207. In this manner, the surface treatment apparatus 201 is configured to clean only a selected surface of component 205.

In the embodiment of FIG. 2, the fluid 213 comprises a cleaning fluid, for example an acid or any other appropriate fluid configured to clean the said portion 203 of the surface of the component 205. For the example of a metallic component, e.g. a titanium acetabular cup, the cleaning fluid may be configured to remove a metal oxide layer from the said portion 203.

The surface treatment apparatus 201 shown in the embodiment in FIG. 2 may be used to selectively clean the said portion 203 of the surface of the component 205 prior to the said portion 203 undergoing a further surface treatment process. In one example of the present disclosure, the surface treatment apparatus 201 may be used to selectively clean the said portion 103, 203 of the component 105, 205 prior to the surface treatment apparatus 101 being used to selectively, anodise the said portion 103, 203 of the component 105, 205. However, in an alternative example, the surface treatment apparatus 201 may be used subsequent to another surface treatment process.

The invention claimed is:

1. A method of selectively anodizing a selective portion of a component to color-code that portion using an anodizing apparatus, the method comprising:

providing a conductive element submerged in an electrolyte fluid within a fluid reservoir of the anodizing apparatus;

positioning the component adjacent the electrolyte fluid with one or more surfaces of the component in selective contact with a conformable wicking element of the anodizing apparatus, wherein the conformable wicking element is at least partially formed of a porous material and is configured to conform to and take a shape of the one or more surfaces of the component;

supporting the conformable wicking element on the conductive element that comprises a cathode plate of an electrical circuit, and wherein the conformable wicking element is at least partially submerged in the electrolyte fluid and has an upper surface that is positioned above a surface of the electrolyte fluid due to the support of the conductive element;

absorbing a desired amount of the electrolyte fluid into the conformable wicking element from the fluid reservoir such that one or more portions of the conformable wicking element in selective contact with the one or more surfaces of the component contain the electrolyte fluid; and sequent to absorbing the desired amount of the electrolyte fluid into the conformable wicking element, bringing the component into contact with the upper surface of the conformable wicking element, wherein the upper surface of the conformable wicking element conforms to the said portion of the surface of the component and the electrolyte fluid completes the electrical circuit between the component and the conductive element, and applying an electric current along the electrical circuit between the conductive element and the component to grow an anodized layer on the one or more surfaces of the component that are in selective contact with the conformable wicking element to achieve a desired colored appearance for the one or more surfaces of the component.

2. The method of claim 1, further comprising rotating the component relative to the conformable wicking element.

3. The method of claim 1, further comprising vibrating the component relative to the conformable wicking element.

4. The method of claim 1, further comprising changing a contact pressure between the component and the conformable wicking element.

5. The method of claim 1, further comprising adjusting an amount of electrical current supplied between the component and the conformable wicking element to thereby control a thickness of the anodizing layer.

6. The method of claim 5, wherein adjusting an amount of the electrical current supplied includes:

monitoring an electrical resistance of the electrical circuit and determine a thickness of the anodized layer based on the electrical resistance; and automatically adjusting the supply of electric current to the electrical circuit in response to readings of the electrical resistance of the electrical circuit, thereby controlling the thickness of the anodized layer.

7. The method of claim 1, further comprising priming the conformable wicking element with the fluid.

8. The method of claim 1, wherein the electrical current has an applied current density of between 30 and 300 amperes/meter$^2$.

9. The method of claim 1, wherein a voltage applied to the electrical circuit is between 50 volts and 70 volts.

10. The method of claim 1, wherein the electrolyte fluid comprises phosphoric acid.

11. The method of claim 1, wherein the conductive element has one or more grooves running at least partially across a surface of the conductive element, the grooves being configured to allow the fluid to flow across the surface of the conductive element.

12. The method of claim 11, further comprising pumping the electrolyte fluid from the fluid reservoir through the one or more grooves.

13. The method of claim 1, wherein the component comprises an acetabular cup and the one or more surfaces comprise a rim of the acetabular cup.

14. The method of claim 1, wherein the component forms an anode of the electrical circuit.

15. The method of claim 1, wherein the conformable wicking element comprises a sheet of fibrous paper.

16. The method of claim 1, further comprising cleaning the one or more surfaces of the component with a cleaning fluid configured to remove an oxide layer from the component.

17. The method of claim 1, wherein the conductive element comprises a first layer of a non-porous conductive material and a second layer of porous conductive material configured to absorb the electrolyte fluid.

18. The method of claim 1, further comprising a second wicking element configured to absorb the electrolyte fluid, the second wicking element being in contact with the conformable wicking element, wherein the conformable wicking element is configured to draw the electrolyte fluid from the second wicking element.

19. A method of selectively anodizing a selective portion of a component to color-code that portion using an anodizing apparatus, the method comprising:

providing a conductive element submerged in a fluid comprising phosphoric acid within a fluid reservoir of the anodizing apparatus;

positioning the component adjacent the fluid with one or more surfaces of the component in selective contact with a conformable wicking element of the anodizing apparatus, wherein the conformable wicking element is formed of fibrous paper and is configured to conform to and take a shape of the one or more surfaces of the component;

supporting the conformable wicking element on the conductive element that comprises a cathode plate of an electrical circuit, and wherein the conformable wicking element is at least partially submerged in the fluid and has an upper surface that is positioned above a surface of the fluid due to the support of the conductive element;

absorbing a desired amount of the fluid into the conformable wicking element from the fluid reservoir such that one or more portions of the conformable wicking element in selective contact with the one or more surfaces of the component contain the fluid; and sequent to absorbing the desired amount of the fluid into the conformable wicking element, bringing the component into contact with the upper surface of the conformable wicking element, wherein the upper surface of the conformable wicking element conforms to the said portion of the surface of the component and the fluid completes the electrical circuit between the component and the conductive element, and applying an electric current along the electrical circuit between the conductive element and the component to grow an anodized layer on the one or more surfaces of the component that are in selective contact with the conformable wicking element to achieve a desired colored appearance for the one or more surfaces of the component.

* * * * *